United States Patent [19]

Myerson et al.

[11] 4,128,034

[45] * Dec. 5, 1978

[54] PRESSURE BAR FOR A CAPO TASTO

[76] Inventors: Elliott L. Myerson, 1815 Grismer St., Burbank, Calif. 91504; Richard W. Gillis, 5661 Cleon St., North Hollywood, Calif. 91601

[ * ] Notice: The portion of the term of this patent subsequent to Sep. 20, 1994, has been disclaimed.

[21] Appl. No.: 807,797

[22] Filed: Jun. 20, 1977

Related U.S. Application Data

[63] Continuation-in-part of Ser. No. 650,147, Jan. 19, 1976, Pat. No. 4,048,894.

[51] Int. Cl.[2] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 583,102 | 5/1897 | Utt | 84/318 |
| 3,647,930 | 3/1972 | Wowries | 84/318 |
| 3,680,427 | 8/1972 | Valentino | 84/318 X |
| 3,722,346 | 3/1973 | Valentino | 84/318 |
| 3,933,077 | 1/1976 | Dunlop | 84/318 |
| 4,048,894 | 9/1977 | Myerson et al. | 84/318 |

*Primary Examiner*—Lawrence R. Franklin
*Attorney, Agent, or Firm*—W. Edward Johansen

[57] ABSTRACT

The invention is a pressure bar for a capo tasto which attaches itself to a stem of a stringed instrument, having a fret board and strings adjacent to the fret board, and which depresses the strings against the fret board in order to change the key of the stringed instrument. The capo tasto includes a pressure bar having a length adapted to extend across the fret board of the stringed instrument, a mounting member for mounting the pressure bar on the stem of the stringed instrument so that it is disposed perpendicular to the longitudinal axis of the stem adjacent to the fret board and a pressure applicating device for applying pressure to the surface of the stem oppositely disposed to the surface on which the fret board is placed so that pressure is transmitted through the mounting member to the pressure bar. The pressure bar is a multi-surface member which is formed from a pliable material so that it will not damage the strings of the stringed instrument and which is mechanically coupled to the mounting member so that it may rotate about its longitudinal axis in order to allow its various surfaces to contact the strings and the fret board of the stringed instrument. One type of pressure bar has three flat orthogonal surfaces and one concave surface and the second type of pressure bar has four flat surfaces and two concave surfaces, which differ in degrees of concavity.

4 Claims, 4 Drawing Figures

PRESSURE BAR FOR A CAPO TASTO

This patent application is a continuation-in-part application filed by the inventors on Jan. 19, 1976, having Ser. No. 650,147 and entitled Capo Tasto, now U.S. Pat. No. 4,048,894.

BACKGROUND OF THE INVENTION

1. Field of the Invention

The invention relates to an attachment for a stringed instrument, such as a guitar, and more particularly to an improved pressure bar for a capo tasto which is secured to the stem of the stringed instrument so as to clamp all of its strings to its fret board at a temporary fret position.

2. Description of the Prior Art

U.S. Pat. No. 390,612, entitled Capodastro for Guitars, issued to George D. Moffat on Oct. 2, 1888 describes a capo tasto which includes a C-shaped mounting member, having a first end and a second end, which is adapted to being disposed about the stem of a stringed instrument perpendicular to the longitudinal axis of the stem. The capo tasto also includes a pressure bar, having a first end and a second end, which is hinged or pivoted at a point intermediate to its first and second ends to the first end of the C-shaped mounting member and disposed in the same plane as the C-shaped mounting member. The pressure bar may be provided with a pad of cork or any other suitable material so that the pressure bar does not injure the strings. Furthermore, the pressure bar is self-adjusting and is free to tilt about its point of pivotal suspension so that it can properly depress the strings regardless of the capo tasto's position on the guitar-stem. The capo tasto finally includes a cam level mechanically coupled to the second end of the C-shaped mounting member and disposed in the same plane as the C-shaped mounting member so that the cam lever is parallel to the transverse axis of the guitar-stem. The cam lever is a disc which is eccentrically pivoted upon the second end of the C-shaped mounting member. An alternative embodiment of this capo tasto may include a bearing plate, that is operated by an adjusting screw so that the capo tasto may be clamped to the guitar neck. The inability of this capo tasto to center itself makes it difficult for a musician to easily and speedily change from one fret position to another fret position.

Two of the most commonly used capo tastos are the Bill Russell capo and the Jim Dunlop capo. The Bill Russell capo is the subject of U.S. Pat. No. 1,788,636, entitled Capo Tasto, issued to Willard H. Russell on Jan. 13, 1931 and includes a rubber pressure bar, which presses against the strings of a stringed instrument, a rigid reinforcing plate which is positioned inside of or on top of the rubber pressure bar and to which the rubber pressure bar is secured, an elastic strip, a portion of which is secured to a first lug on the rubber pressure bar at one end extending over the top of the rubber pressure bar, and secured to a second lug on the rubber pressure bar. The capo tasto is secured to the stem of the stringed instrument by wrapping the remaining portion of the elastic strip about the bottom surface of the stem. The tension on the elastic strip is maintained by a plurality of eyelets positioned on the elastic strip to which a set of pins are coupled. The Jim Dunlop capo is the subject of U.S. Pat. No. 3,185,012, entitled Capo Tasto, issued on Nov. 3, 1965 to James Dunlop and includes a channel of a roughly U-shaped cross-sectional contour molded from plastic, the side flanges which are arranged to diverge slightly and have bevelled end edges, a non-elastic cord is coupled to a cam lever, which is aligned perpendicular to the longitudinal axis of the stem of a stringed instrument on which it is placed and which secures the capo tasto in place on the stem of the stringed instrument.

The disadvantages of both the Jim Dunlop capo and the Bill Russell capo is that a musician cannot easily and speedily change from one fret position to another fret position and he must use both hands to do so. Furthermore, neither of these capos is very durable and each of them has a tendency to wear out quickly.

The inventors are also aware of another set of capos which are manufactured by Hamilton and each of which includes a U-shaped mounting member, having a base, a first arm and a second arm, also a mounting bar, having a first end and a second end, with its first end pivotally hinged to the first arm of the U-shaped member and its second end adapted to latch to the second arm of the U-shaped mounting member, a pressure bar, which mounts on the mounting bar. One of these capos has a screw adjusted pressure plate, that is disposed on the base of the U-shaped mounting member. The other capo is secured to the stem of a stringed instrument by a positively engaging spring device disposed on the base or the U-shaped mounting member. These capos are aesthetically unattractive and require the musician to use his two hands to change from one fret position to another fret position.

U.S. Pat. No. 3,722,346, entitled Capo, issued to Pete P. Valentino on Mar. 27, 1973, teaches an improved capotasto for use in tuning string instruments of the type having a fingerboard including a plurality of transversely oriented frets and a plurality of substantially parallel strings traversing the frets. The capo includes an elongated bar that is repositionable along the fingerboard of a string instrument for uniformly varying the pitch of all of the string. The pressure bar of the capo has a plurality of orthogonally related planar surfaces. The pressure bar of the capo may also be cylindrical.

U.S. Pat. No. 3,823,247, entitled Capo Tasto issued to Herbert Bauerfeind on July 9, 1974, describes a capo tasto which includes a pressure bar, a bowed clamp member hinged to one end of the pressure bar, and a device which interengages the other, unhinged end of the pressure bar in order to secure the capo tasto to the guitar. The pressure bar has a comb-like part, the teeth of which are closely spaced and adapted to press on the strings of the instrument. The disadvantage in using this capo tasto is that a musician must use both his hands to change from one fret position to another fret position. The advantage of this capo tasto is its aesthetic qualities in that it is practically invisible when placed on a stringed instrument.

SUMMARY OF THE INVENTION

In view of the foregoing factors and conditions of the prior art it is a primary object of the present invention to provide a capo tasto for a particular stringed instrument which can be easily adapted to variations of the particular stringed instrument.

It is another object of the present invention to provide a capo tasto for a stringed instrument that is durable and long lasting in its construction and that has a minimum of moving parts.

It is also another object of the present invention to provide a pressure bar for a capo tasto for a stringed instrument that increases the useful life of the capo tasto.

It is still another object of the present invention to provide a capo tasto for a stringed instrument which does not aesthetically detract from the appearance of the stringed instrument.

It is yet another object of the present invention to provide a pressure bar for a capo tasto for a stringed instrument which adapts to any type of stem of a stringed instrument.

In accordance with an embodiment of the present invention a pressure bar for a capo tasto for a stringed instrument, having a stem or neck, a fret board with several fret positions mounted on the stem, and a set of strings, has been described.

The capo tasto includes a pressure bar having a length adapted to extend across the fret board of the stringed instrument, a mounting member for mounting the pressure bar on the stem of the stringed instrument so that it is disposed perpendicular to the longitudinal axis of the stem adjacent to the fret board and a pressure applicating device for applying pressure to the surface of the stem oppositely disposed to the surface on which the fret board is placed so that the pressure is transmitted through the mounting member to the pressure bar. The pressure bar is a multi-surface member which is formed from a pliable material so that it will not damage the strings of the stringed instrument and which is mechanically coupled to the mounting member so that it may rotate about its longitudinal axis in order to allow its various surfaces to contact the strings and the fret board of the stringed instrument. One type of pressure bar has three flat orthogonal surfaces and one concave surface and second type of pressure bar has four flat surfaces and two concave surfaces, which differ in degrees of concavity.

The features of the present invention which are believed to be novel are set forth with particularity in the appended claims. Other objects and many more of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
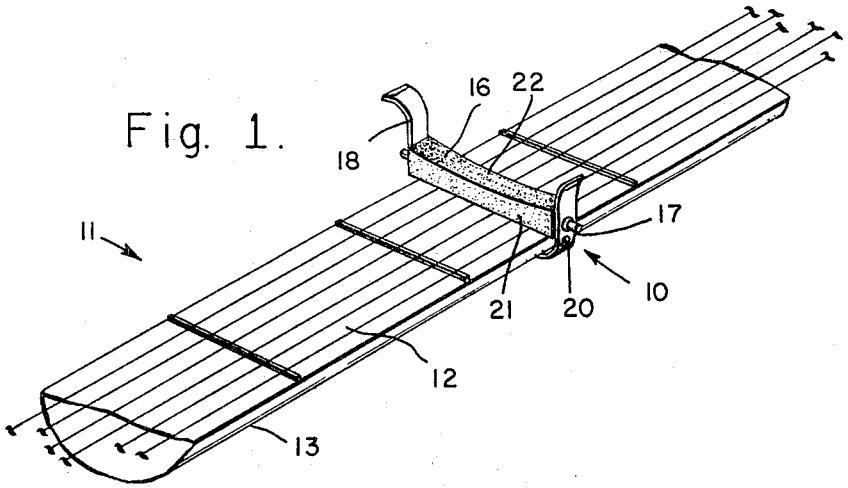
FIG. 1 is a perspective view of a stem of a stringed instrument, having a fret board and a set of strings, on which a capo tasto, having a pressure bar of a first type which is constructed in accordance with the principles of the present invention, is mounted.

The present invention is a capo tasto which is used on a stringed instrument for changing the key of the stringed instrument. In order to best understand the present invention it is necessary to view a preferred embodiment of the present invention in use on a stringed instrument. Referring to FIG. 1 a capo tasto 10 is mounted on a stringed instrument 11 having a fret board 12 disposed on a stem 13 having a top surface, two curved side surfaces and a bottom surface. The stringed instrument has a set of strings running parallel to the stem 13 and adjacent to the fret board 12. The capo tasto 10 includes a pressure bar 16, a mounting bar 17 on which the pressure bar 16 is mounted and an elastic mounting strap 18 which is mechanically coupled to both ends of the mounting bar 17 through a group of eyelets 20.

Figure 2:
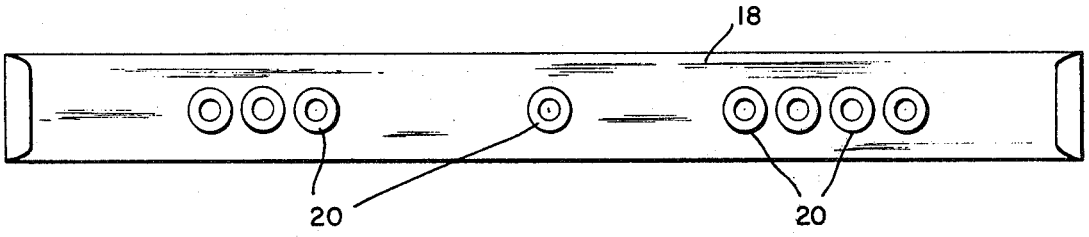
FIG. 2 is a plan view of the mounting strap of the capo tasto of FIG. 1.

Referring to FIG. 2 and to U.S. Pat. No. 1,788,638 it is noted that the inventors have improved their capo tasto by adding several more eyelets 20 to the elastic mounting strap 18 so that it is now reversible.

Referring again to FIG. 1 it can readily be noted that the pressure bar 16 has a concave surface 21 and three flat surfaces 22, that are orthogonal to each other, disposed parallel to the transverse axis of the stem 13 of the string instrument when the capo tasto 10 is mounted thereon.

Figure 3:
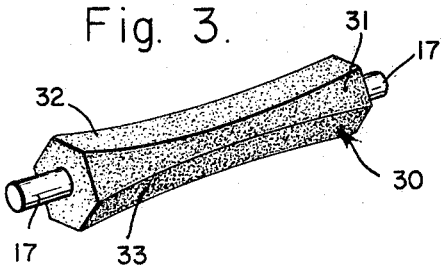
FIG. 3 is a perspective view of a pressure bar of a second type.

FIG. 3 illustrates a pressure bar 30 of a second type which has a hexagonal cross-section and has a set of four flat surfaces 31 and two concave surfaces 32, differing in degrees of concavity.

Figure 4:
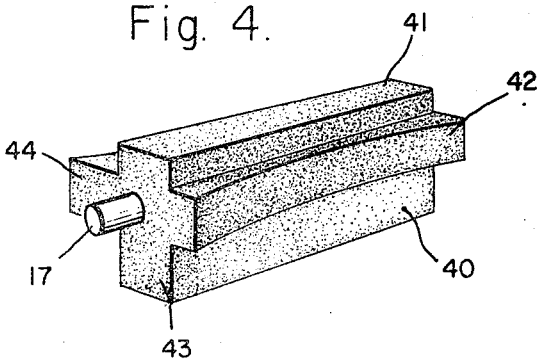
FIG. 4 is a perspective view of a pressure bar of a third type.

FIG. 4 illustrates a pressure bar 40 of a third type which has a cross-section of a cross with a short top surface 41, a short right side surface 42, a long bottom surface 43, and a long side surface 44. The top and bottom surfaces 41 and 43 are flat. The long side surfaces 42 and 44 are concave. The combining of flat surfaces and concave surfaces on the pressure bars enable the capo tastos of the present invention to be used on a variety of stringed instruments. The use of the pressure bar 40 of the third type further enhances the adaptability and the useful life of the capo tastos on which it is used.

Until the present invention capo tastos were not versatile enough to be used on both a flat surface of one stringed instrument and a curved surface of a similar stringed instrument. Furthermore, the capo tastos of the prior art were difficult to use and required two hands to change from one fret position to another. The advantage of a capo tasto of the present invention is that it not only may be easily and speedily changed from one fret position to another with one hand but also it has a long useful life in that its moving parts are formed from a durable material such as a plastic or a metal. Further illustrating the versatility of the present invention is that a variety of pressure bars, either a C-shaped member or a U-shaped member and either a centrically mounted progressively stepped cam or a eccentrically mounted disc may be mixed to form various embodiments of the present invention.

From the foregoing it can be seen that a capo tasto has been described which is not only functionally superior to prior art capo tastos but which is more aesthetically appealing than the same capo tastos. The capo tasto includes an elastic mounting strap, a pressure bar and a mounting bar on which the pressure bar is mounted. Furthermore, it should be noted that the schematics of the capo tasto are not drawn to scale and the distances of and between figures are not to be considered significant.

Accordingly, it is intended that the foregoing disclosure and showing made in the drawing shall be considered only as illustrations of the principle of the present invention.

What is claimed is:

1. An improved pressure bar to be used in combination with a capo tasto, which attaches itself to a stem of a stringed instrument, having a fret board and strings adjacent to the fret board, and which depresses the strings against the fret board, the capo tasto includes:

a. mounting means for mounting said pressure bar on the stem of the stringed instrument so that it is disposed perpendicular to the longitudinal axis of the stem and parallel to the transverse axis of the stem adjacent to the fret board; and b. pressure applicating means for applying pressure to the surface of the stem oppositely disposed to the surface on which the fret board is placed so that the pressure is transmitted through said mounting means to said pressure bar, said pressure applicating means coupled to said mounting means, said improved pressure bar, comprising:

a. a multi-surface member having a length adapted to extend across the fret board, said multi-surface member being mechanically coupled to said mounting means so that it may rotate on its longitudinal axis and said multi-surface member also having a first plurality of flat surfaces and a second plurality of concave surfaces, each of which differ in degrees of concavity.

2. A capo tasto according to claim 1 wherein said pressure bar has three flat orthogonal surfaces and at least one concave surface which are disposed parallel to the transverse axis of the stem of the stringed instrument, said pressure bar formed from a pliable material so that the strings of the stringed instrument will not be damaged when the pressure bar is applied against them.

3. A capo tasto according to claim 1 wherein said pressure bar has four flat surfaces and two concave surfaces, differing in degree of concavity, which are disposed parallel to the transverse axis of the stem of the stringed instrument, said pressure bar formed from a pliable material so that the strings of the stringed instrument will not be damaged when the pressure bar is applied against them.

4. A capo tasto according to claim 1 wherein said mounting means is a metal shaft having a first end and a second end and said pressure applicating means comprises:

a. an elastic strap having a first plurality of eyelets which are disposed so that one of said eyelets is mechanically coupled to said first end of said metal shaft and a second plurality of eyelets which are disposed so that one of said eyelets is mechanically coupled to said second end of said metal shaft after said capo tasto has been placed on the stem of the stringed instrument, said first and second pluralities of eyelets are oppositely disposed so that said elastic strap may be reversed thereby doubling the life of said elastic strap.

* * * * *